US005133323A

United States Patent [19]

Treusch

[11] Patent Number: 5,133,323

[45] Date of Patent: Jul. 28, 1992

[54] INTAKE MANIFOLD PRESSURE COMPENSATION FOR THE CLOSED-LOOP PRESSURE REGULATION OF A FUEL PUMP

[75] Inventor: Christopher J. Treusch, St. Clair Shores, Mich.

[73] Assignee: Siemens Automotive L.P., Auburn Hills, Mich.

[21] Appl. No.: 720,964

[22] Filed: Jun. 25, 1991

[51] Int. Cl.[5] ..... F02M 39/00

[52] U.S. Cl. ..... 123/494; 123/463; 123/497; 73/119 A

[58] Field of Search ..... 123/497, 499, 463, 494; 73/119 A

[56] References Cited

U.S. PATENT DOCUMENTS

| | | | |
|---|---|---|---|
| 3,699,931 | 10/1972 | Cinquegrani | 123/497 |
| 4,248,194 | 2/1981 | Drutchas | 123/357 |
| 4,426,978 | 1/1984 | Sasaki | 123/463 |
| 4,756,291 | 7/1988 | Cummins | 123/497 |
| 4,829,964 | 5/1989 | Asayama | 123/463 |
| 4,920,942 | 5/1990 | Fujimori | 123/494 |
| 4,926,829 | 5/1990 | Tuckey | 123/497 |
| 4,951,636 | 8/1990 | Tuckey | 123/497 |

*Primary Examiner*—Carl S. Miller

*Attorney, Agent, or Firm*—George L. Boller; Russel C. Wells

[57] ABSTRACT

The fuel supply system of an internal combustion engine delivers liquid fuel to electrically operated fuel injectors by means of an electric pump whose output pressure is regulated by control electronics which receives as feedback from a pressure sensor connected into a fuel delivery passage serving the injectors a signal representing the pressure differential between manifold absolute pressure (MAP) and absolute pumped fuel pressure. The pressure sensor has a movable wall that divides its interior into an intake manifold pressure sensing chamber space communicated to the engine intake manifold and a fuel pressure sensing chamber space communicated to the fuel delivery line to the injectors. A magnet is mounted on a central region of the movable wall to transmit a signal to a Hall-effect sensor mounted within the intake manifold pressure sensing chamber space. The feedback pressure signal is derived from the Hall-effect sensor sensing the position of the magnet, and hence that of the movable wall.

8 Claims, 1 Drawing Sheet

INTAKE MANIFOLD PRESSURE COMPENSATION FOR THE CLOSED-LOOP PRESSURE REGULATION OF A FUEL PUMP

FIELD OF THE INVENTION

This invention relates to internal combustion engine fuel systems.

BACKGROUND AND SUMMARY OF THE INVENTION

U.S. Pat. No. 4,756,291 discloses a pressure control for the fuel system of an internal combustion engine. The known system has a pressure sensor in a fuel line between an electric fuel pump and a carburetor. The pressure sensor supplies to electrical control circuitry a signal representing the sensed pressure. The electrical control circuitry in turn controls the electrical power to the pump such that the fuel pressure delivered to the carburetor is closed-loop regulated to a commanded pressure. The commanded pressure may be established by an engine management computer, and is subject to being varied in accordance with engine operating conditions. The disclosure of U.S. Pat. No. 4,756,291 is directed toward elimination of a fuel return line from the engine for returning excess pumped fuel to the fuel tank.

Certain U.S. patents relate to electronic multi-point fuel injection systems. Typically, such a system comprises a fuel rail assembly that contains several electrically operated fuel injectors and a mechanical fuel pressure regulator. Fuel is pumped into the fuel rail assembly at a rate exceeding the maximum engine demand. The fuel pressure regulator regulates the pumped fuel pressure, returning excess fuel to the tank via a return line. The typical pressure regulator comprises a housing divided by a movable wall into a fuel pressure chamber that is communicated to the fuel in the fuel rail assembly and a chamber that is communicated to intake manifold vacuum. The movable wall carries a valve element that co-acts with an internal seat in the fuel pressure chamber to control the return fuel flow such that the pressure in the fuel rail is thereby regulated to a pressure that is pressure-compensated with respect to changes in intake manifold pressure whereby the pressure across each fuel injector is held substantially constant despite variations in the intake manifold pressure. In the typical naturally aspirated engine, the intake manifold pressure is sub-atmospheric, ranging from relatively high vacuum at light loads to relatively low vacuum at high loads. With a substantially constant pressure drop across a fuel injector, the amount of fuel injected by the injector for each injection is a function of the electrical pulse width energization of the injector applied by an associated engine management computer.

If it is attempted to embody an electronic fuel injection fuel system, such as one of those of the patents referred to in the immediately preceding paragraph, with a pump whose output pressure is electrically controlled in the manner of the first-mentioned patent above, the failure to take the intake manifold pressure into account will introduce error into the fuel injections whenever the intake manifold pressure varies from a particular set-point. The use of pressure regulators such as those just described will obviously be unacceptable since a return line is required, and the disclosure of the first-mentioned patent apparently does not appear to address any question of intake manifold pressure, possibly because of the fact that it uses a carburetor.

The present invention relates to a new and unique internal combustion engine fuel system in which the electric power delivered to an electrically powered fuel pump is controlled by means of closed-loop feedback which derives a feedback signal from a pressure sensor that takes intake manifold pressure variations into account. As a result, the pump output pressure is closed-loop regulated to commanded pressure despite the variations in intake manifold pressure that typically occur during engine operation.

The invention includes the advantages of: embodying the fuel pressure sensing and intake manifold pressure sensing functions in a single device; eliminating any need to interface with a separate MAP (manifold absolute pressure) sensor; and possible savings in wiring and circuitry. Further features, advantages, and benefits of the invention will be seen in the ensuing description and claims which are accompanied by drawings. The drawings disclose a presently preferred embodiment of the invention according to the best mode contemplated at the present time in carrying out the invention.

DESCRIPTION OF THE PREFERRED EMBODIMENT

Figure 1:
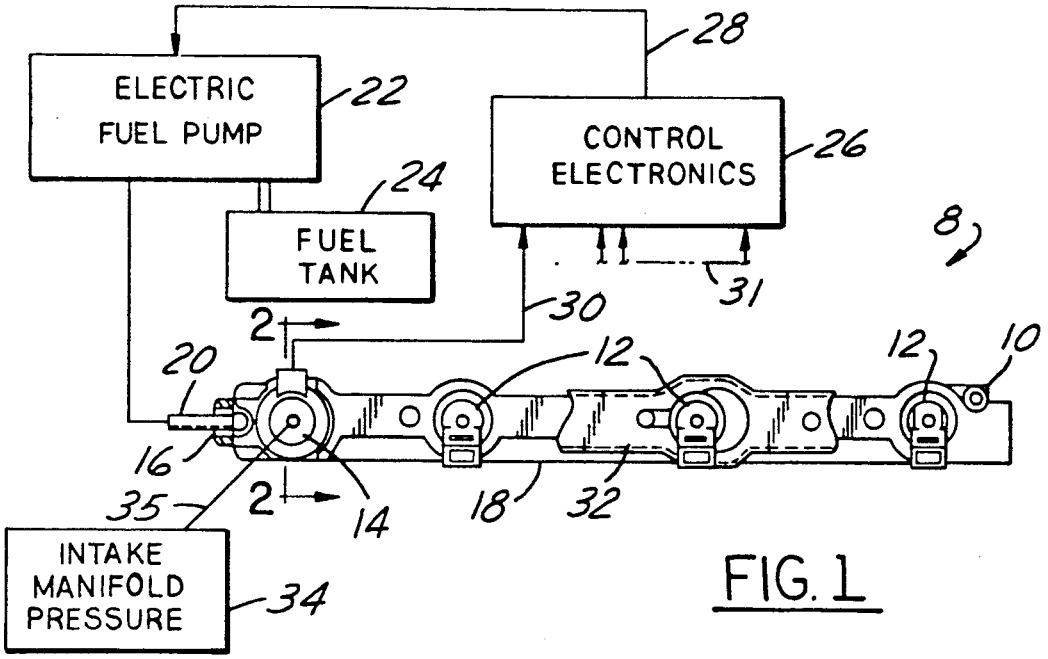
FIG. 1 is a partially schematic plan view of a fuel system according to principles of the invention.

FIG. 1 shows a fuel supply system 8 for an internal combustion engine in accordance with principles of the invention. The system includes a fuel rail assembly 10 containing several electrically operated fuel injectors 12 and a single pressure sensor 14 at spaced apart locations along its length. Fuel enters the fuel rail assembly at a port 16 at one lengthwise end. The opposite end is closed. The fuel injectors and pressure sensor are disposed in respective sockets that are provided in body 18 of the fuel rail assembly. These sockets transversely intercept the main fuel passage that extends longitudinally into the body from port 16. A tubular conduit 20 extends from an electric fuel pump 22 to port 16 for conveying liquid fuel from the pump to the fuel rail assembly. Pump 22 draws fuel from a fuel tank 24.

The system further includes control electronics 26 which receives an electric signal from pressure sensor 14 via an electrical connection 30 and delivers electric power to pump 22 via an electrical connection 28. There are other inputs to control electronics 26, and they are represented generally by reference numeral 31. A retainer 32 that is removably fastened to body 18 serves to keep the fuel injectors and the pressure sensor captured in their respective sockets in body 18. Intake manifold pressure 34 (MAP) is obtained from the intake manifold and supplied to pressure sensor 14 via a conduit 35.

Figure 2:
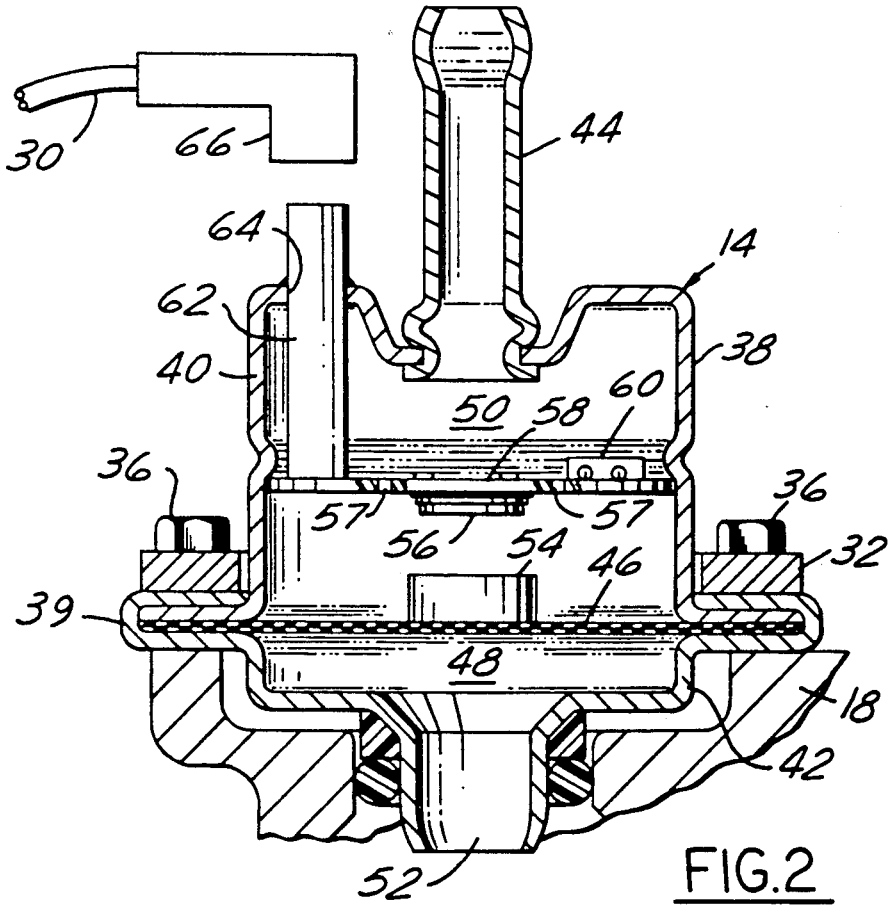
FIG. 2 is an enlarged cross sectional view through a portion of FIG. 1, generally in the direction of arrows 2—2.

Further detail of pressure sensor 14 is presented in FIG. 2. The pressure sensor comprises a housing 38, generally cylindrical, that is shown captured in its socket in body 18 by retainer 32. Screws 36 that are disposed at particular locations are an illustrative means of attachment of the retainer to the body, and the retainer is shaped to retain the sensor by engaging a circular flange 39 of housing 38 that radially overlaps the rim of the socket and forcing the flange against an annular surface portion of body 18 that surrounds the socket rim.

Housing 38 comprises an upper housing part 40 and a lower housing part 42. A nipple 44 extends through and is affixed to the upper end wall of part 40. The two parts 40, 42 are united by flange 39 and capture between them the radially outer margin of a movable wall 46. Wall 46 divides the interior of housing 38 into a lower fuel pressure sensing chamber space 48 and an upper intake manifold pressure sensing chamber space 50. A nipple 52 that is formed integrally with the central region of the bottom end wall of housing part 42 places chamber space 48 in communication with the fuel in the fuel rail assembly. One end of conduit 35 fits over nipple 44 for communicating chamber space 50 with intake manifold pressure.

A permanent magnet 54 is affixed to the central region of wall 46 on the face thereof that is exposed to chamber space 50. A Hall-effect sensor 56 is affixed to the central region of an electronic circuit board assembly 58 that is mounted on housing 38 by any suitable means of attachment in proper position within chamber space 50 relative to permanent magnet 54. The circuit board assembly, including sensor 56, is disposed in spaced apart, generally parallel relation to wall 46, including magnet 54. There are through-apertures 57 in the circuit board assembly so that the mounting of the circuit board assembly does not create a restriction between the respective portions of chamber space 50 that lie on opposite sides of the circuit board assembly. The face of the circuit board assembly that is opposite the face containing sensor 56 contains certain electronic circuit components, reference numeral 60, associated with the sensor to form in conjunction therewith a sensing circuit. The sensing circuit has an output that is connected to an electrical connector plug 62. Plug 62 is mounted on circuit board assembly 58 and extends through a hole 64 in the housing wall so that its exterior termination can mate with a complementary connector plug 66 at one end of the connection 30 leading to the control electronics.

Wall 46 possesses a certain inherent flexibility and resiliency that enable it to resiliently flex in response to changing pressure differential between the two chamber spaces 48, 50. In particular, the wall's central region is able to be selectively positioned in the axial sense to correspondingly position magnet 54 axially relative to Hall-effect sensor 56. Assuming that the illustrated position in FIG. 2 represents a certain pressure differential between the two chamber spaces, then an increasing intake manifold pressure relative to fuel pressure will result in magnet 54 being positioned increasingly further away from the Hall-effect sensor while a decreasing intake manifold pressure relative to fuel pressure will result in the magnet being positioned increasingly closer toward the Hall-effect sensor.

Hall-effect sensor 56 is responsive to the amount of magnetic flux that is incident on it. Hence, as the magnet is increasingly moved away, less flux is incident on the sensor while as the magnet is positioned increasingly toward the sensor, the amount of magnetic flux increases. The sensor produces an output that is indicative of the flux that is incident upon it. The circuitry on the circuit board assembly processes the sensor signal into a suitable signal that can be relayed to control electronics 26. Accordingly, the pressure sensor 14 provides, via connector plug 62, a signal that is indicative of the pressure differential between manifold absolute pressure (MAP) and pressure of fuel pumped by pump 22. The control electronics 26 acts upon this signal to cause the pump output pressure to be closed-loop regulated to a commanded pressure that will cause the pressure differential across each fuel injector to be essentially independent of changes in the manifold absolute pressure. Thus, the magnet is a transmitter of the selective positioning of wall 46, and sensor 56 is a receiver of the position information transmitted.

In use of the fuel rail, the variable output pressure fuel pump produces an output pressure that is set by the engine management computer and closed-loop regulated in the manner that has been herein described. Each fuel injector delivers injections of fuel into the air entering the cylinder's combustion chamber so that a combustible mixture is thereby created and combusted in the combustion chamber to power the engine.

Pressure sensor 14 can be fabricated by conventional fabrication techniques. If calibration of the pressure sensor is necessary, it can be performed by conventional calibration techniques, externally, and/or internally. Calibration is frequently done by adjustment or trimming of signal conditioning circuitry associated with the sensor. External calibration of pressure sensor 14 can be performed by connecting the sensor with external signal conditioning circuitry, which may or may not be additional to any circuitry on circuit board assembly 58 associated with Hall sensor 56, and adjusting or trimming such external circuitry during the calibration procedure. Where the circuitry to be trimmed or adjusted is on circuit board assembly 58, the housing is designed to provide suitable access to the component(s) to be trimmed or adjusted, or it could even be possible to obtain access via nipple 44.

While a presently preferred embodiment of the invention has been disclosed, it should be appreciated that the inventive principles can be practiced in embodiments that fall within the scope of the following claims.

What is claimed is:

1. In an internal combustion engine having a fuel supply system comprising a variable output pressure electric pump that pumps liquid fuel through a fuel discharge device into an air passage to form a combustible air-fuel mixture that is combusted in combustion chamber space of the engine to power the engine, and wherein the output pressure of the pump is controlled by a pressure sensor that is disposed to sense the pressure of the fuel being pumped by said pump and that acts via an electronic feedback control loop containing control electronics to cause the pump output pressure to be closed-loop regulated to a commanded pressure, the improvement which comprises said pressure sensor comprising a housing divided by a movable wall into a fuel pressure sensing chamber space and an intake manifold pressure sensing chamber space, means communicating said fuel pressure sensing chamber space to sense the pressure of the fuel being pumped by said pump, means communicating said intake manifold pressure sensing chamber space to an intake manifold of the engine to sense intake manifold pressure, means to cause said movable wall to be selectively positioned within said housing in accordance with the pressure differential between said fuel pressure sensing chamber space and said intake manifold pressure sensing chamber space, signal generating means for generating a signal indicative of the position to which said movable wall is selectively positioned, and means for relaying said signal to said control electronics, and wherein said control electronics comprises means acting upon said signal in furtherance of the closed-loop regulation of the commanded pump pressure, said signal generating means comprising transmitter means that is carried by said movable wall to transmit the selective position assumed by said movable wall in response to the pressure differential between said fuel pressure sensing chamber space and said intake manifold pressure sensing chamber space, and receiver means for generating said signal disposed within said intake manifold pressure sensing chamber space so as to be exposed to the pressure in said intake manifold pressure sensing chamber space for receiving from said transmitter means the selective position assumed by said movable wall, said receiver means generating said signal, and wherein said receiver means is mounted on an electronic circuit board assembly that is disposed within said intake manifold pressure sensing chamber space so as to be exposed to the pressure in said intake manifold pressure sensing chamber space, said receiving means comprising a receiver mounted on said electronic circuit board assembly and electronic circuitry mounted on said electronic circuit board assembly separate from, but in electrical association with, said receiver for co-action with said receiver to provide said signal, and electrical connector means extending from said electronic circuit board assembly in sealed relation through said housing to provide for the delivery for said signal to said control electronics.

2. The improvement set forth in claim 1 in which said transmitter means is disposed within said intake manifold pressure sensing chamber space in non-contacting relation to said receiver means.

3. The improvement set forth in claim 2 in which said transmitter means comprises a permanent magnet.

4. The improvement set forth in claim 3 in which said receiver comprises a Hall-effect sensor.

5. For use in an internal combustion engine having a fuel supply system comprising a variable output pressure electric pump that pumps liquid fuel through a fuel discharge device into an air passage to form a combustible air-fuel mixture that is combusted in combustion chamber space of the engine to power the engine, and wherein the output pressure of the pump is controlled by a pressure sensor that is disposed to sense the pressure of the fuel being pumped by the pump and that acts via an electronic feedback control loop containing control electronics to cause the pump output pressure to be closed-loop regulated to a commanded pressure, wherein said control electronics comprises means acting upon said signal in furtherance of the closed-loop regulation of the commanded pump pressure, an improved form of said pressure sensor which comprises a housing divided by a movable wall into a fuel pressure sensing chamber space and an intake manifold pressure sensing chamber space, means providing for the communicating of said fuel pressure sensing chamber space for sensing the pressure of the fuel being pumped by the pump, means providing for the communicating of said intake manifold pressure sensing chamber space for sensing intake manifold pressure, means to cause said movable wall to be selectively positioned within said housing in accordance with the pressure differential between said fuel pressure sensing chamber space and said intake manifold pressure sensing chamber space, signal generating means for generating a signal indicative of the position to which said movable wall is selectively positioned, and means providing for the relaying of said signal to the control electronics, said signal generating means comprising transmitter means that is carried by said movable wall to transmit the selective position assumed by said movable wall in response to the pressure differential between said fuel pressure sensing chamber space and said intake manifold pressure sensing chamber space, and receiver means for generating said signal disposed within said intake manifold pressure sensing chamber space for exposure to the pressure in said intake manifold pressure sensing chamber space and for receiving from said transmitter means the selective position assumed by said movable wall, said receiver means generating said signal, and wherein said receiver means is mounted on an electronic circuit board assembly that is disposed within said intake manifold pressure sensing chamber space for exposure to the pressure in said intake manifold pressure sensing chamber space, said receiving means comprising a receiver mounted on said electronic circuit board assembly and electronic circuitry mounted on said electronic circuit board assembly separate from, but in electrical association with, said receiver for co-action with said receiver to provide said signal, and electrical connector means extending from said electronic circuit board assembly in sealed relation through said housing to provide for the delivery for said signal to the control electronics.

6. The improved form of pressure sensor as set forth in claim 5 in which said transmitter means is disposed within said intake manifold pressure sensing chamber space in non-contacting relation to said receiver means.

7. The improved form of pressure sensor as set forth in claim 6 in which said transmitter means comprises a permanent magnet.

8. The improved form of pressure sensor as set forth in claim 7 in which said receiver comprises a Hall-effect sensor.

* * * * *